US008479752B2

(12) United States Patent
Duffield et al.

(10) Patent No.: US 8,479,752 B2
(45) Date of Patent: Jul. 9, 2013

(54) CLEANING DEVICE

(75) Inventors: Paul John Duffield, Hull (GB); Madeleine Chadwick, Hull (GB)

(73) Assignee: Reckitt & Colman (Overseas) Limited, Slough, Berkshire (GB)

( * ) Notice: Subject to any disclaimer, the term of this patent is extended or adjusted under 35 U.S.C. 154(b) by 495 days.

(21) Appl. No.: 12/809,222

(22) PCT Filed: Dec. 18, 2008

(86) PCT No.: PCT/GB2008/004170
§ 371 (c)(1),
(2), (4) Date: Sep. 20, 2010

(87) PCT Pub. No.: WO2009/081104
PCT Pub. Date: Jul. 2, 2009

(65) Prior Publication Data

US 2011/0000979 A1 Jan. 6, 2011

(30) Foreign Application Priority Data

Dec. 24, 2007 (GB) ..... 0725217.4

(51) Int. Cl.
*B65D 83/16* (2006.01)
*B05D 7/24* (2006.01)

(52) U.S. Cl.
USPC ... 134/104.2; 134/172; 134/198; 222/402.11; 222/402.13; 222/635

(58) Field of Classification Search
USPC ..... 134/198, 172, 104.2; 222/635, 402.11, 222/402.13
See application file for complete search history.

(56) References Cited

U.S. PATENT DOCUMENTS 3,156,382 A * 11/1964 Michell ..... 222/182
3,306,252 A * 2/1967 Knight et al. ..... 118/710

(Continued)

FOREIGN PATENT DOCUMENTS

DE 2055159 A1 5/1972
EP 1762509 A 3/2007

(Continued)

OTHER PUBLICATIONS

English Language Abstract for DE2055159 supplied by Google Translate.

*Primary Examiner* — Michael Barr
*Assistant Examiner* — Kevin G Lee
(74) *Attorney, Agent, or Firm* — Norris McLaughlin & Marcus PA

(57) ABSTRACT

A device for cleaning a surface comprises a pressurized container containing a cleaning composition; a nozzle through which the composition is arranged to be dispensed, in use, upon an actuation of a valve; a shroud attached to the container and surrounding the nozzle. The shroud has a hollow generally cylindrical portion adjacent to the nozzle for guiding the dispensed product in the direction in which it leaves the nozzle, and a flared portion at the end of the cylindrical portion furthest from the nozzle forming a spreading plate for guiding the dispensed product laterally when in contact, in use, with a surface to be cleaned. The nozzle is arranged to be actuated by movement of the container towards the shroud. The device comprises a reservoir. The nozzle and shroud are configured so that, in use, the cleaning composition is directed across the surface to be cleaned and into the reservoir. The device comprises a latch movable into a blocking position upon actuation of the device in which position it blocks a further actuation of the device. The latch is releasable to a position in which the device can be further actuated. The latch is arranged to be moved to an emptying position in which the reservoir can be emptied before it can be moved to the actuating position.

8 Claims, 10 Drawing Sheets

U.S. PATENT DOCUMENTS

Figure 1:
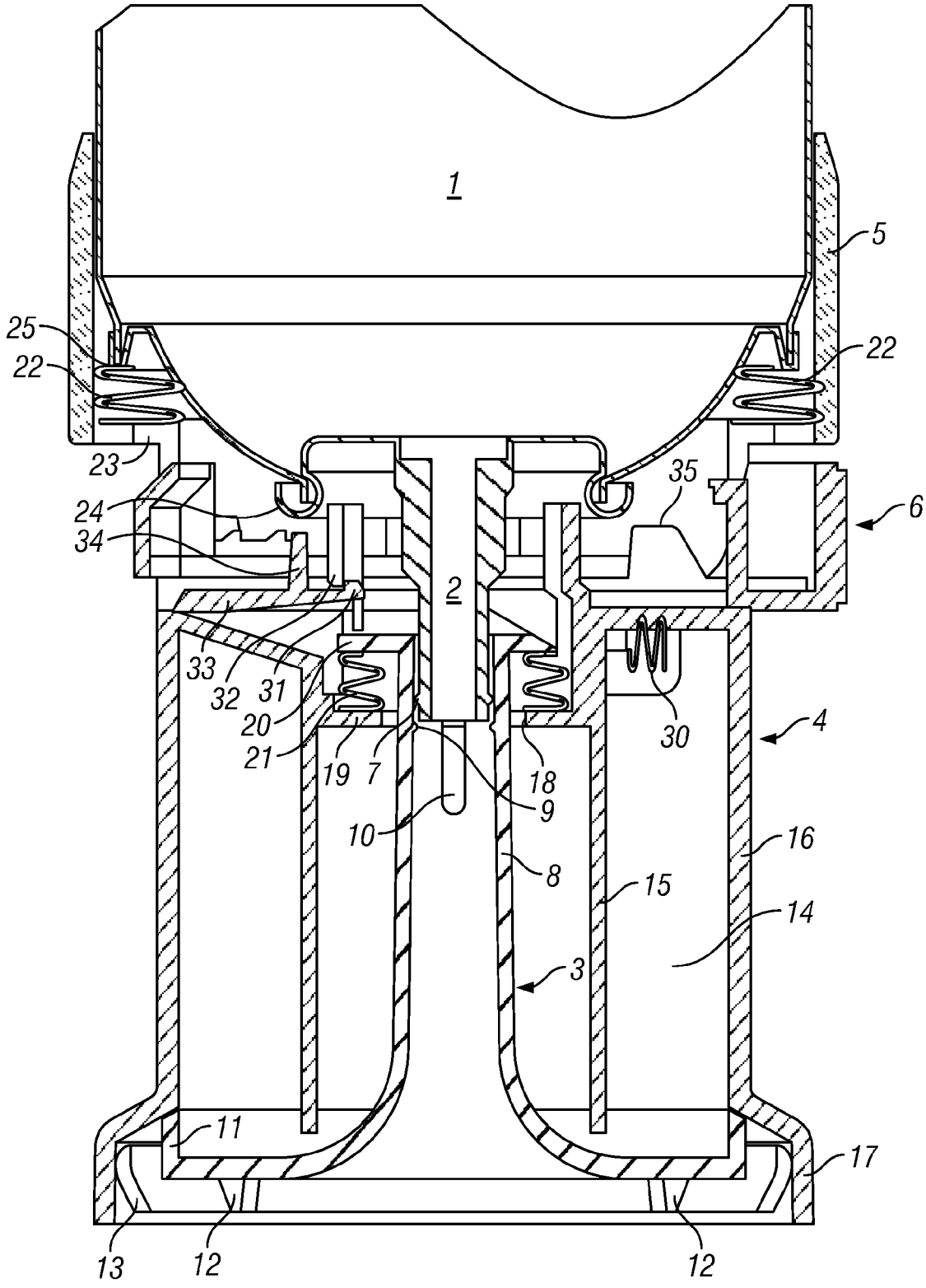

| | | | | | |
|---|---|---|---|---|---|
| 3,726,444 | A | * | 4/1973 | Ostrowsky et al. | 222/402.11 |
| 3,744,678 | A | * | 7/1973 | Beres et al. | 222/205 |
| 3,768,707 | A | * | 10/1973 | Nigro | 222/402.13 |
| 3,770,170 | A | * | 11/1973 | Hayes | 222/402.11 |
| 3,841,532 | A | * | 10/1974 | Gores | 222/205 |
| 3,844,448 | A | * | 10/1974 | Sette | 222/153.12 |
| 3,865,283 | A | * | 2/1975 | Hayes | 222/402.11 |
| 3,934,761 | A | * | 1/1976 | Gentreau | 222/183 |
| 3,935,974 | A | * | 2/1976 | Weyn | 222/402.13 |
| 3,935,999 | A | * | 2/1976 | Weyn | 239/288.5 |
| 3,936,000 | A | * | 2/1976 | Weyn | 239/288.5 |
| 3,946,911 | A | * | 3/1976 | Morane et al. | 222/402.11 |
| 4,013,231 | A | * | 3/1977 | Van Veldhoven | 239/579 |
| 4,024,988 | A | * | 5/1977 | Starrett | 222/153.11 |
| 4,087,022 | A | * | 5/1978 | Zanetti-Streccia | 222/183 |
| 4,277,004 | A | * | 7/1981 | Barlics | 222/402.14 |
| 4,420,099 | A | * | 12/1983 | Pizzurro et al. | 222/205 |
| 4,636,102 | A | * | 1/1987 | Drake | 401/190 |
| 4,679,713 | A | * | 7/1987 | Crapser et al. | 222/402.13 |
| 5,186,364 | A | * | 2/1993 | Laszlo | 222/153.11 |
| 5,335,832 | A | * | 8/1994 | de Laforcade | 222/402.13 |
| 6,592,011 | B1 | * | 7/2003 | Lammel et al. | 222/402.11 |
| 8,042,709 | B2 | * | 10/2011 | Duquet | 222/153.13 |
| 2005/0242123 | A1 | * | 11/2005 | Finlay et al. | 222/189.1 |
| 2006/0219265 | A1 | * | 10/2006 | Shieh et al. | 134/22.1 |
| 2007/0119984 | A1 | * | 5/2007 | Woods | 239/337 |
| 2007/0240707 | A1 | * | 10/2007 | Sauzade et al. | 128/200.14 |
| 2007/0241134 | A1 | * | 10/2007 | Gurrisi et al. | 222/153.11 |

FOREIGN PATENT DOCUMENTS

| | | | |
|---|---|---|---|
| EP | 1762509 | A1 * | 3/2007 |
| GB | 1163573 | A | 9/1969 |
| WO | 2008047073 | A | 4/2008 |

* cited by examiner

CLEANING DEVICE

This is an application filed under 35 USC 371 of PCT/GB2008/004170.

The present invention relates to a device for cleaning a surface comprising:

a pressurised container containing a cleaning composition;

a nozzle through which the composition is arranged to be dispensed, in use, upon an actuation of a valve;

a shroud attached to the container and surrounding the nozzle;

the shroud having a hollow generally cylindrical portion adjacent to the nozzle for guiding the dispensed product in the direction in which it leaves the nozzle, and a flared portion at the end of the cylindrical portion furthest from the nozzle forming a spreading plate for guiding the dispensed product laterally when in contact, in use, with a surface to be cleaned;

wherein the nozzle is arranged to be activated by movement of the container towards the shroud; and a reservoir, wherein the nozzle and shroud are configured so that, in use, the cleaning composition is directed across the surface to be cleaned and into the reservoir.

Such a device will subsequently be referred to as "of the kind described". A device of the kind described is disclosed in PCT/GB02207/003701

The reservoir could be made to be big enough that it will retain all of the composition provided in the container so that the device is suitable for multiple uses. This would result in a large device. Also, the reservoir would have to be carefully engineered to ensure that as a subsequent dose is being captured, the previously captured dose did not leak out of the device through the inlet path for the new dose. A more compact arrangement which does not need to account for the problem of the leakage of a previously captured dosage is therefore desirable. The device may therefore be configured to be of sufficient size to retain only a single dose of the composition. The device may then be sold with instructions to empty the reservoir between each use. The reservoir could be made transparent to provide a visual indication to the user that it is full and a reminder that it should be emptied. However, this relies on the user following the instructions correctly. If they do not, the reservoir will overflow and the Composition will be left on or discharged back onto the surface to be cleaned. The present invention addresses this problem.

According to the present invention, a device of the kind described is characterised by a latch movable into a blocking position upon actuation of the device in which position it blocks further actuation of the device, the latch being releasable to an actuating position in which the device can be further actuated, the latch being arranged to be moved to an emptying position in which the reservoir can be emptied before it can be moved to the actuating position.

The present invention therefore provides a failsafe device. Upon actuation, the latch operates to block further use of the device. The user must release the latch before further actuation is possible. However, before the latch can allow further actuation, the reservoir is opened such that the reservoir can be emptied before the device is able to be used again.

Preferably, the shroud is relatively movable with respect to the reservoir and is biased to a closed position in which it closes the reservoir. This being the case, the latch will be arranged to push the shroud into the open position. Unless the device has been inverted, the composition will automatically be discharged when the latch is moved in this way.

Preferably, the latch is provided with at least one tooth or groove which engages with a respect groove or tooth in the surrounding housing to lock the latch in position with the reservoir open. The latch then has to be positively released at the end of the opening process.

Figure 9:
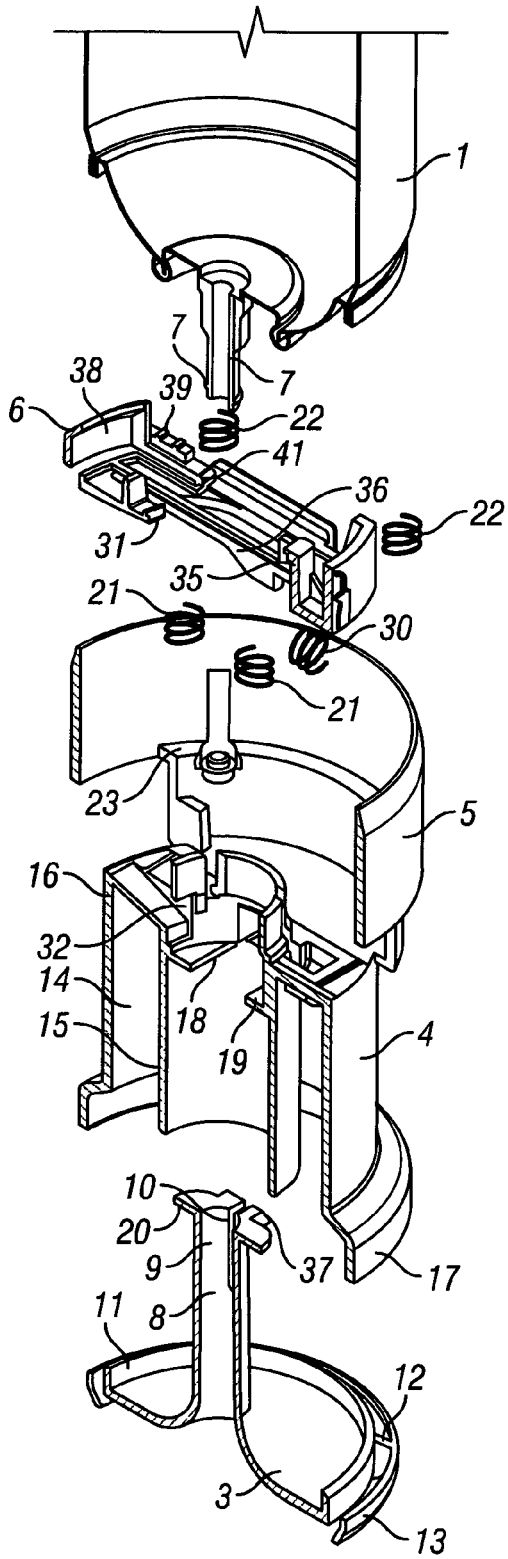
Figures 10A, 10B, 10C:
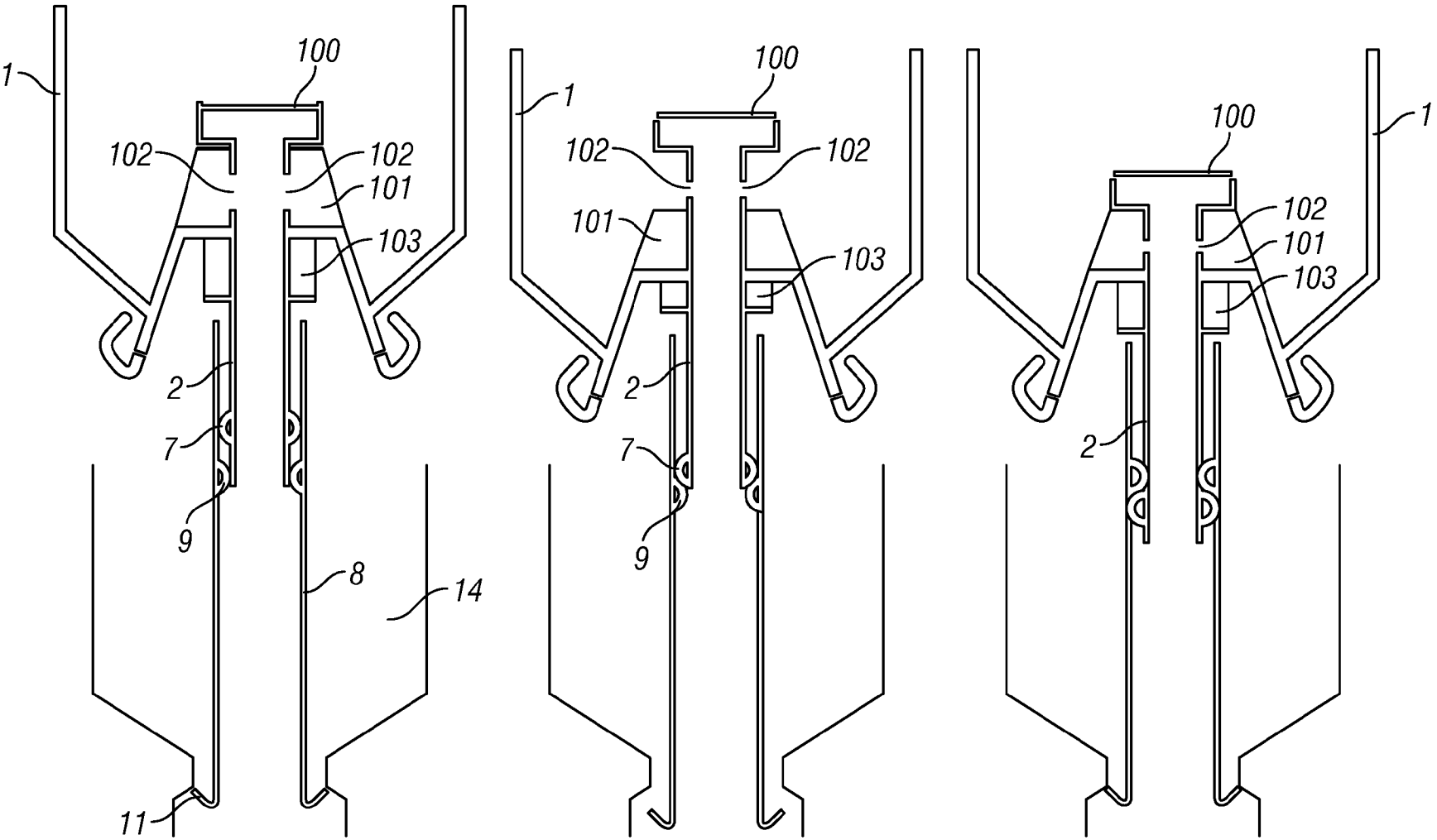

An example of a cleaning device will now be described with reference to the accompanying drawings, in which:

FIGS. 1 to 8 present cross-sections through the device (with the top portion of the container not shown) in various stages of operation;

FIG. 9 is an exploded perspective showing the components from the earlier drawings; and FIGS. 10A to 10C are schematic cross-sections showing the operation of the valve inside the container.

A cleaning device of the kind described is described in our earlier application PCT/GB2007/003701. This describes suitable cleaning compositions and pressurised containers in detail. The description of the cleaning composition and pressurised container applies equally to the present invention and will not be repeated here as the development of this application relates exclusively to the invention head as described below.

The basic structure of the present invention will firstly be described with reference to FIGS. 1 and 9 before the operation of the device is described.

The basic components of the device are the container 1 with a stem valve 2, the shroud 3, reservoir 4 (including collar 5) and slider 6.

The container 1 is typically a aerosol type container as described in more detail in our earlier application. Stem valve 2 is best shown in FIGS. 10A to 10C. The stem valve 2 extends into the container 1 and has an enlarged portion 100 which seats on the valve seat 101 in the form of a washer. The stem valve 2 has a plurality of orifices 102. When the stem valve 2 is pushed upwardly to the position shown in FIG. 10B, the orifices 102 are clear of the valve seat 101, allowing the composition to pass out through the stem valve 2. The stem valve 2 is urged to the closed position by a rubber spring 103 which is compressed as the valve is opened as shown in FIG. 10*b* to provide the closing force.

The stem valve 2 has an annular projection 7 close to its lowermost end. The stem valve 2 fits inside cylindrical portion 8 of shroud 3.

The cylindrical portion 8 is provided with a restriction 9. There may be a plurality of projections based around the circumference of the cylindrical portion 8 which provide the restriction 9. Alternatively, there may be a single annular projection. The cylindrical portion has a pair of axial grooves 10 on opposite sides of the cylindrical portion (only one of these is shown in the drawings). These grooves 10 provide a degree of flexibility to the walls of the cylindrical portion 8 which prevent the sticking of the projection 7 within the restriction 9 and prevents damage to the shroud. The bottom end of the shroud 3 has a trumpet-like configuration and the radially outermost edge of the shroud 3 has an upwardly extending lip 11 which seals against the reservoir housing 4 as described below. A plurality of spacers 12 extend radially outwardly from the lip 11 and support a spacer ring 13 which terminates below the shroud 3 as is shown in FIG. 1. This arrangement is similar to that described in FIG. 4 of PCT/GB2007/003701. The reservoir 4 has an annular reservoir chamber 14 defined by inner 15 and outer 16 walls, the outer wall having a flared portion 17 at its lowermost end in which the spacer ring 13 fits. As shown in FIG. 1, this flared portion 17 terminates beneath the lowermost edge of spacer ring 13. The lip 11 abuts against and seals with the top part of flared portion 17 to seal the reservoir chamber 14 as shown in FIG. 1. The central region towards the top of the reservoir housing 4 is provided with an opening 18 through which the cylindrical portion 8 of the shroud 3 passes. The opening 18 is partially surrounded by a lip 19 which faces an outwardly extending flange 20 at the top of the shroud 3. Between the lip 19 and the flange 20, shroud are a pair of springs 21 which provide a biasing force to bias the shroud to the uppermost position as shown in FIG. 1. An additional biasing force is provided by a second pair of springs 22 which act between a rim 23 on the top of the reservoir housing 4 and a shoulder 25 on the top of the container 1. The second springs 22 provide a biasing force between the container and the reservoir housing 4.

The basic dispensing operation will now be described.

When a user needs to clean a surface, for example, cleaning a stain from a carpet, they place the flared portion 17 over the site to be cleaned and simply press the container 1 downwardly and hold it in position. This triggers a series of events within the device as follows.

Figure 2:
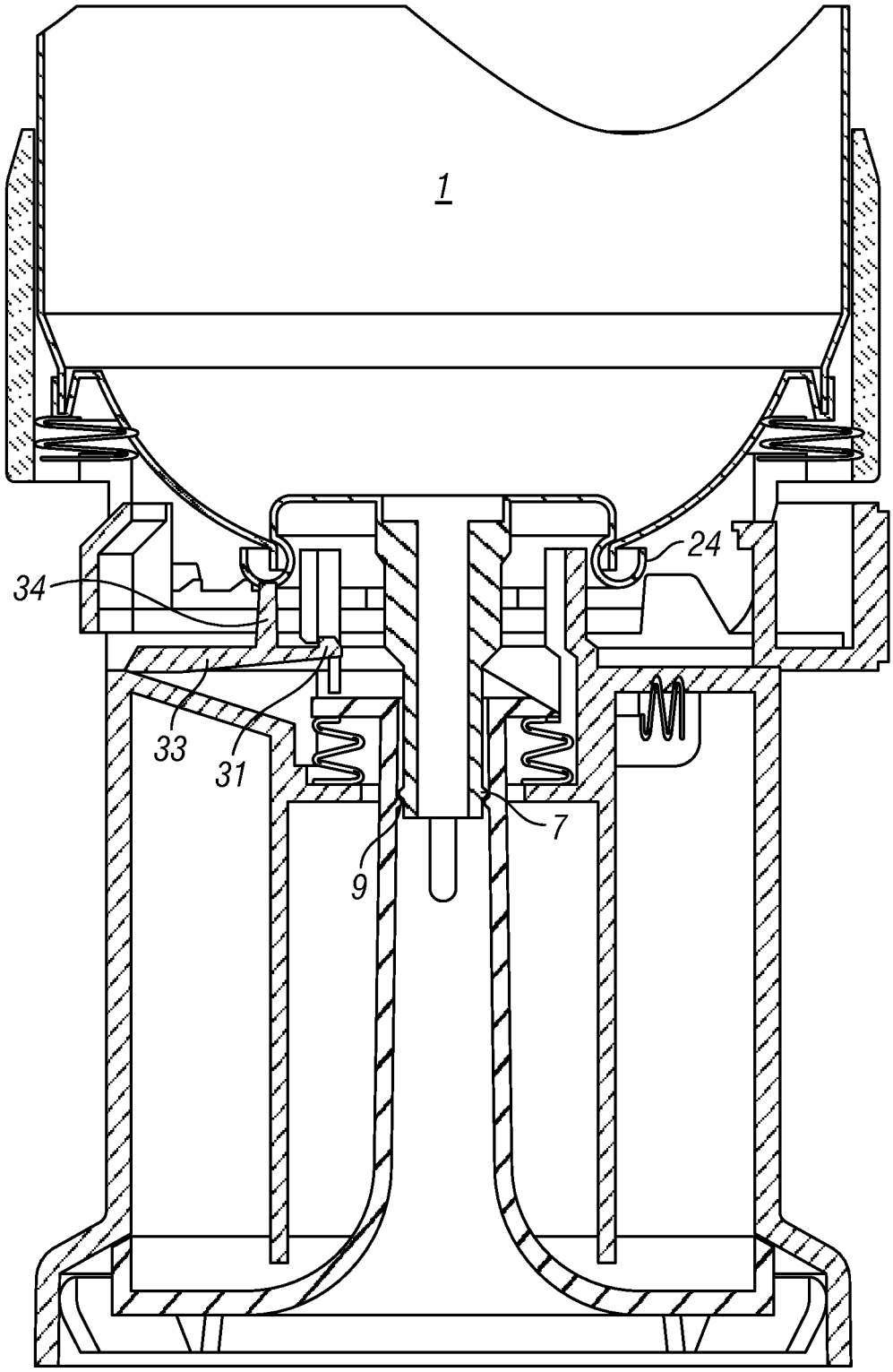
Figure 3:
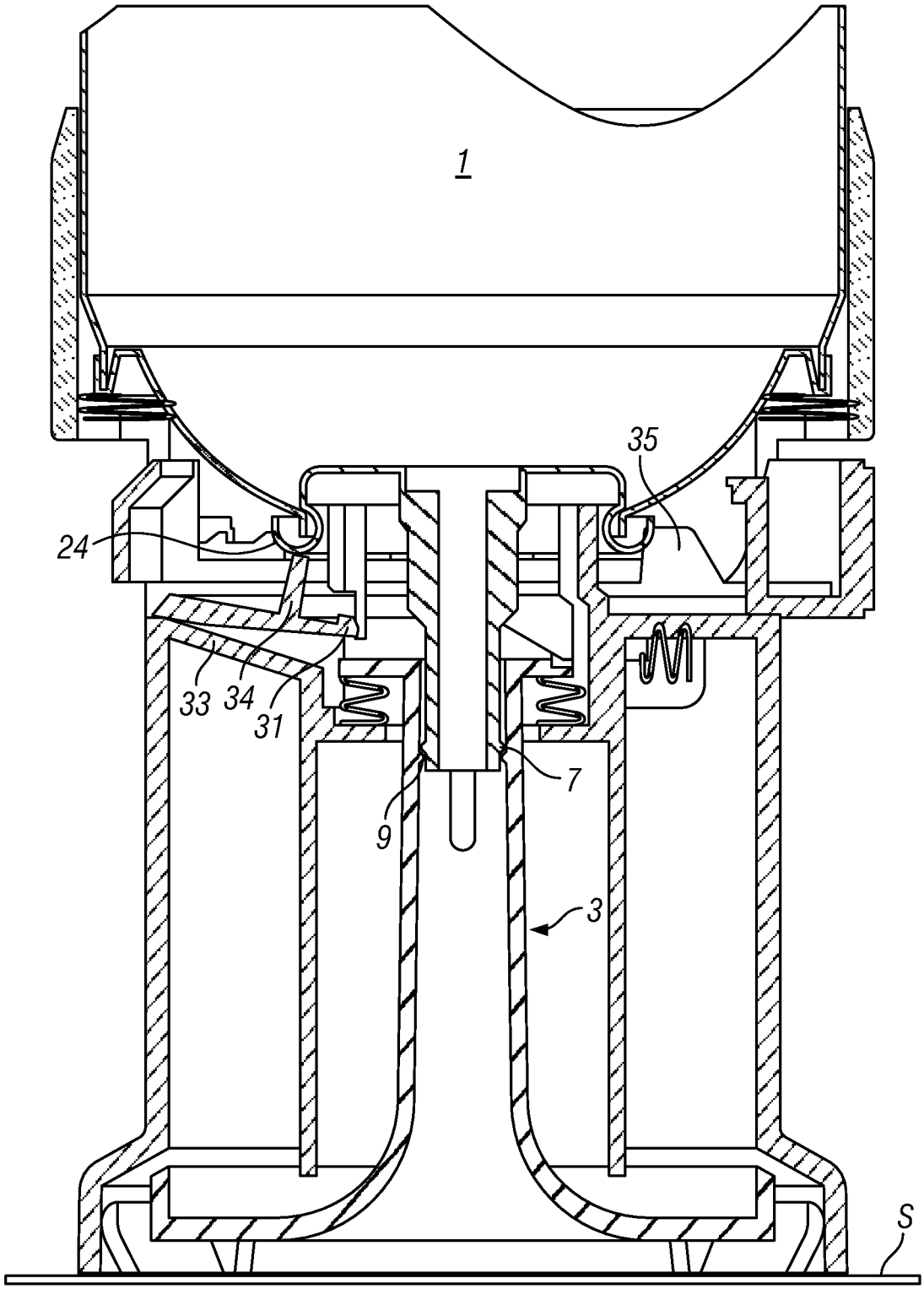
Figure 4:
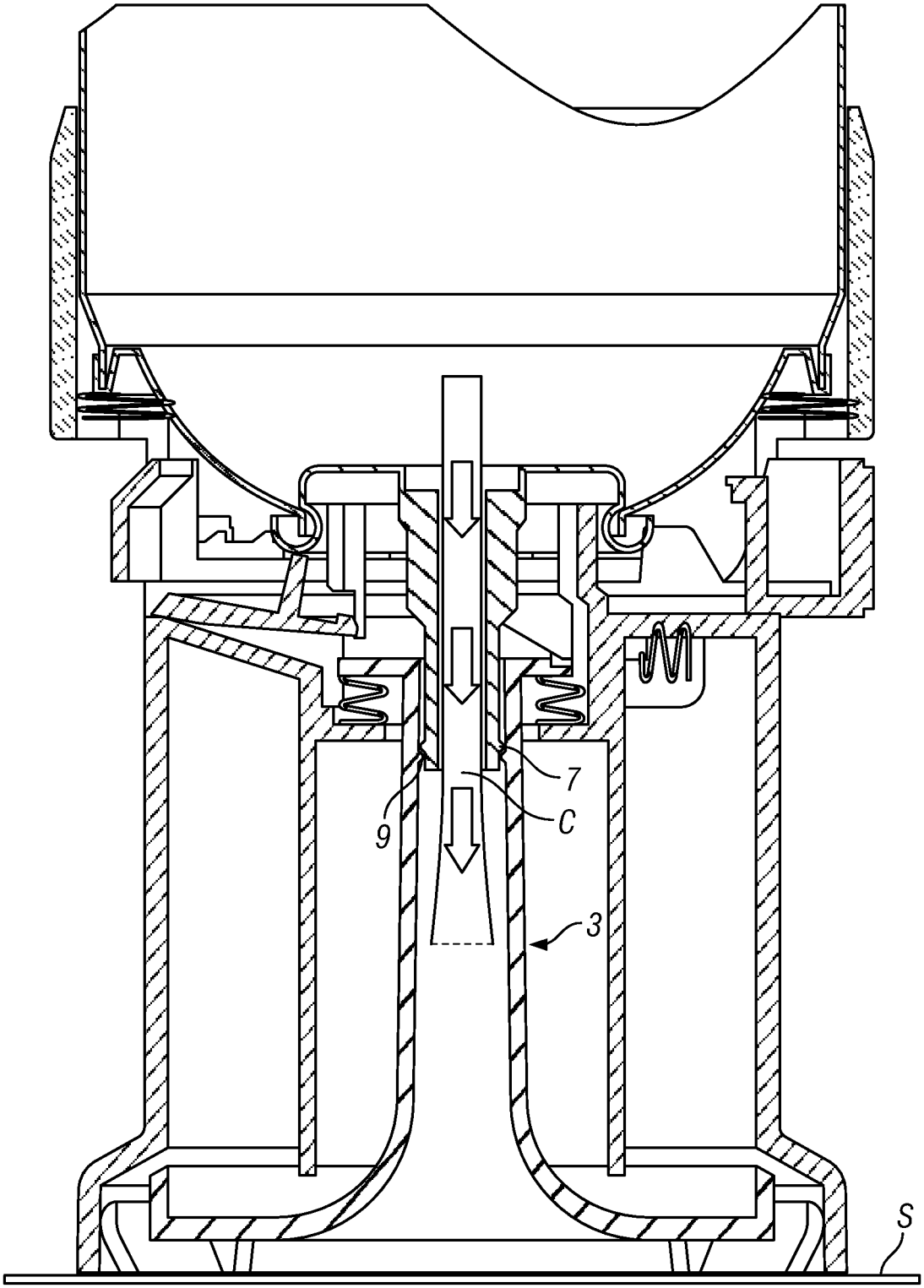
Figure 5:
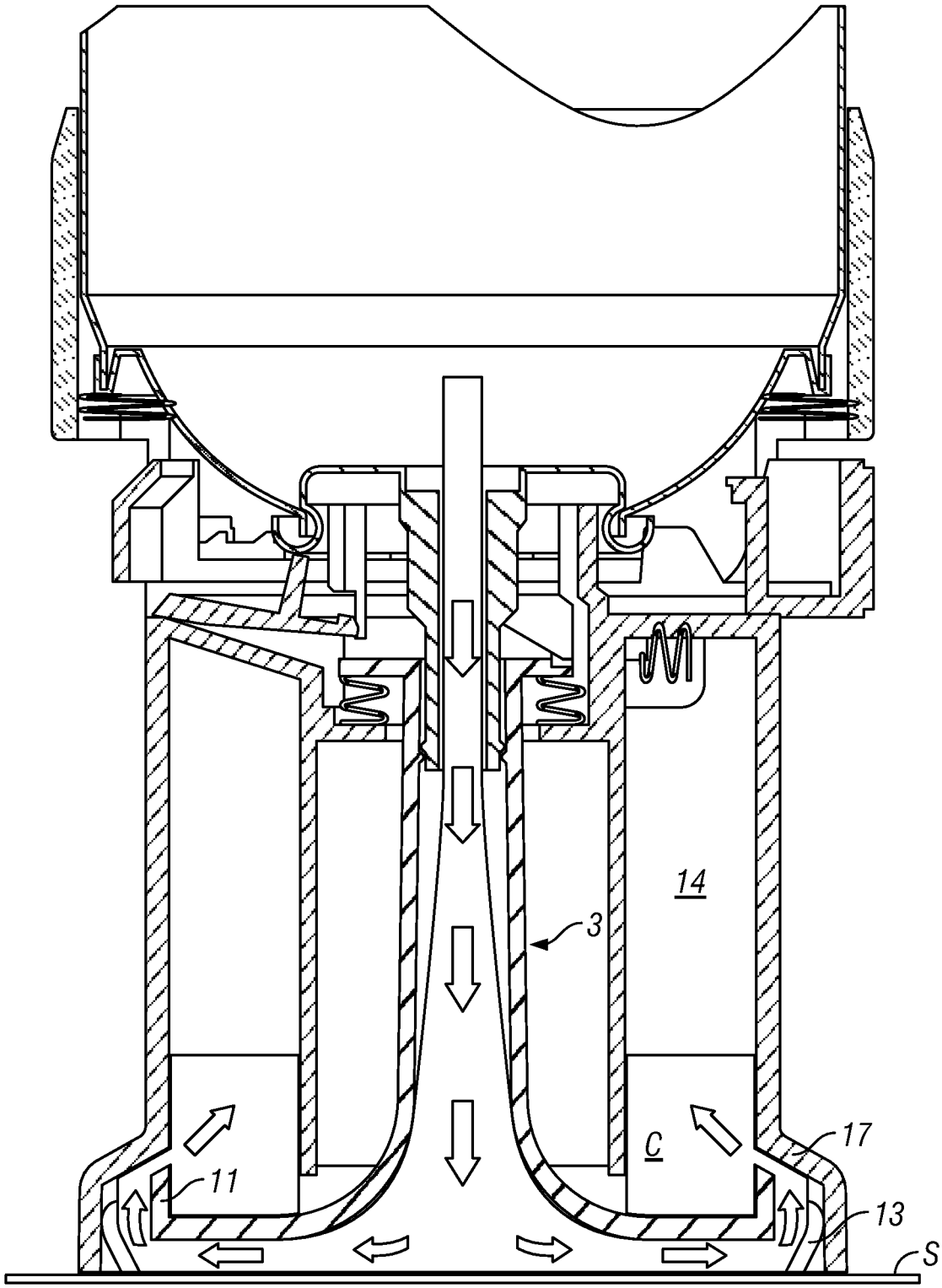
Figure 6:
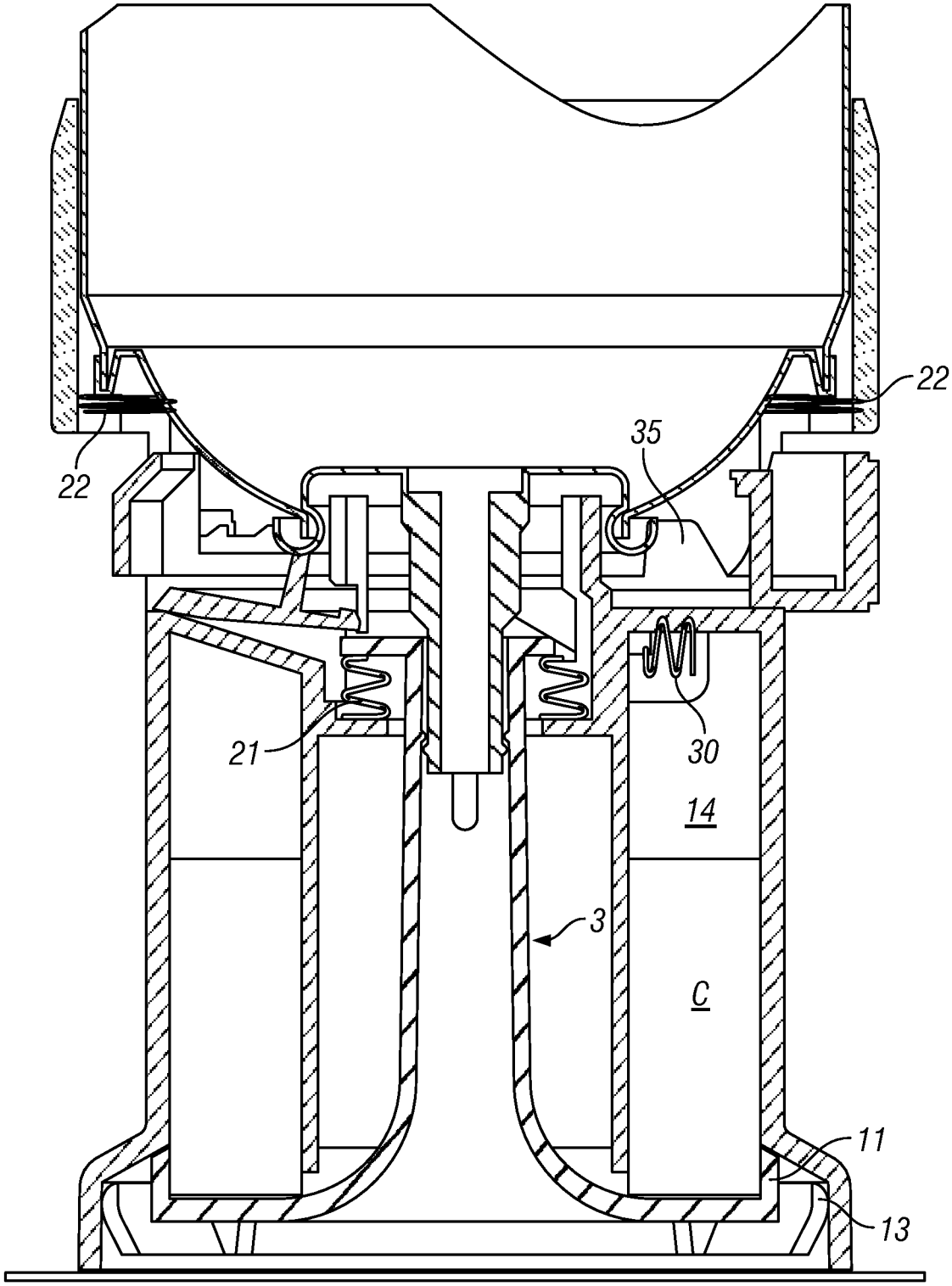

Firstly, the container 1 moves downwardly from the position shown in FIGS. 1 and 10A to the position shown in FIGS. 2 and 10B such that the projection 7 makes contact with the restriction 9. This "picks up" the shroud 3 moving it downwardly onto the surface S to be cleaned as shown in FIG. 3. At the same time, the engagement of the projection 7 and restriction 9 causes an increased pressure on the stem valve 2 which opens the stem valve to dispense the composition C as shown in FIG. 4. The composition travels down the shroud 3, radially outwardly across the gap defined between the flared portion of the shroud 3 and the surface S to be cleaned. Any dirt on the surface S, or for example in the pile of the carpet into which the composition penetrates is picked up and is guided by the spacer 13 and flared portion 17 into the reservoir chamber 14. This continues until most of the composition has entered the reservoir chamber 14. This is represented in FIGS. 4 to 6.

The rubber spring 103 is compressed by the motion described above. When this rubber approaches its fully compressed state, this causes the compression to stop and hence the downward pressure on the container to exert a slightly increased force on the stem valve 2. This increased force causes the projection 7 to push past the restriction 9 as shown in FIG. 6. This has a number of effects. It results in a sudden decrease in pressure of the rubber spring 103 which causes the stem valve 2 to snap back into place as shown in FIG. 10C. The springs 21 push on the flange 20 at the top of the shroud 3 lifting the shroud 3 and spacer 13 to the position shown in FIG. 6 in which the lip 11 again contacts the flared portion 17 of the reservoir housing to seal composition C within the reservoir 14.

Figure 7:
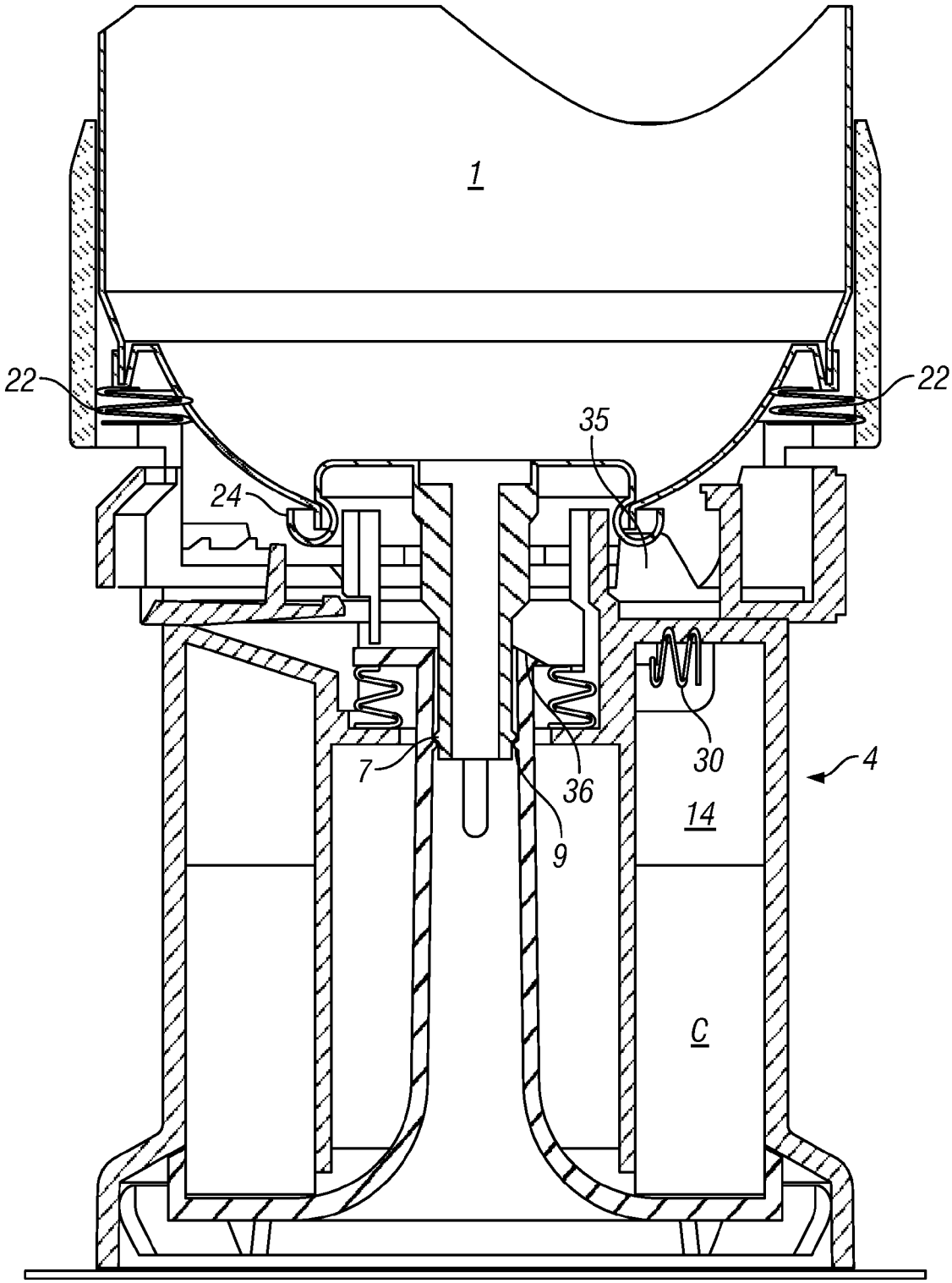

When the downward pressure on the container 1 is released, the springs 22 urge the container 1 upwardly with respect to the reservoir housing 4 thereby causing the projection 2 to pass back through the restriction 9 to the position shown in FIG. 7. As an alternative or in addition to the springs 22, a manually operable device may be provided to generate the restoring force on the container 1. This manually operable may be a cam groove on the slider 6. The slider 6 is described below, but does not have such a cam groove as, in the described example, the springs 22 provide the necessary return force. If both the springs and a slider are used, the springs assist in the manual return actuated by the slider. One benefit of using the slider for this is that it can be configured such that the device cannot be returned to an actuation position without first passing through an emptying position.

The process described above is the basic process by which the composition is dispensed and stored in the reservoir. The manner in which the device is locked and emptied will now be described.

The locking and emptying functions are provided by the latch 6. The latch has a number of different components each fulfilling a specified function. The latch 6 is slidably retained within the reservoir housing 4 such that it slides across the plane of the paper in FIGS. 1 to 8, a spring 30 projects between the latch 6 and the reservoir housing 4 to urge the latch 6 to the left as shown in the drawings.

The structure of the latch is best understood together with its functionality. The description below therefore describes the structure of the latch together with the appropriate functionality through all of the stages of operation.

In FIG. 1, the latch is in position to allow dispensing of composition C from the container 1. In this position, it is at the right-hand end of its travel. The spring 30 is in a compressed state. The latch 6 is prevented from moving to the left by engagement of a catch 31 under a downwardly facing lip 32 on the reservoir housing 4. The catch 31 is provided on a resilient arm 33 which has an upwardly extending engagement projection 34. As the container 1 moves downwardly from the position shown in FIG. 1 to the position shown in FIG. 3, a bead 24 on top of the container 1 contacts the engagement projection 34 (as shown in FIG. 2) and pushes the arm downwardly in the position shown in FIG. 3 where the catch 31 is released from the lip 32. As the latch 6 is released, the spring 30 pushes the latch 6 slightly to the left shown by the difference in position between FIGS. 1 and 3. Further movement to the left is prevented at this time by engagement between the bead 24 on the top of the container 1 and a blocking projection 35 which extends upwardly from the bottom of the latch 6.

When the container is lifted up as shown in the transition between FIGS. 6 and 7. This lifts bead 24 to release the latch 6 to be urged by the spring 30 fully to the left to the position shown in FIG. 7. This is the position in which the reservoir chamber 14 retains the full dose of composition. In this position, further actuation of the device is prevented by engagement between the bead 24 on the container 1 with the blocking projection 35 as shown in FIG. 7. This prevents a consumer from activating the device a second time and hence overfilling the reservoir chamber 14.

Figure 8:
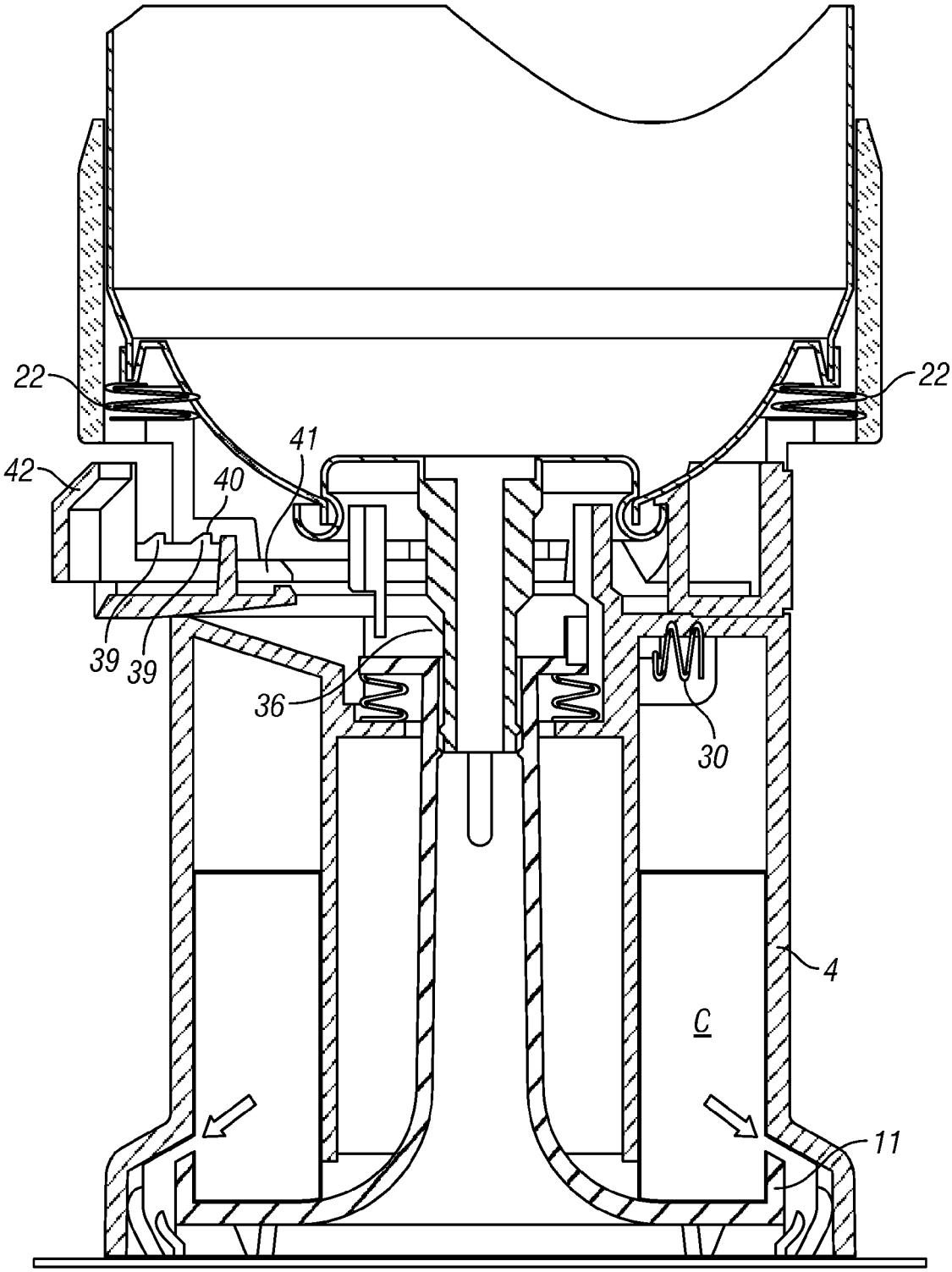

In order to employ the reservoir chamber 14, the user pushes the latch to the left as shown in FIG. 8. The effect of this movement is shown in FIG. 8. The latch 6 has a downwardly facing ramp 36 which provides a cam surface which bears against a corresponding inclined surface 37 on flange 20 shown in FIG. 9. As the latch 6 is slid to the left, the ramp 36 pushes the shroud down to the position shown in FIG. 8. This allows the composition C to be emptied through the gap between the lip 11 and the reservoir housing 4. The device can be tipped slightly in order to empty the composition which would otherwise be trapped by the lip 11 but this is not necessary to the operation of the device.

The latch is held in the emptying position by means of a sprung catch 38. This is provided with a pair of teeth 39 one of which, in the emptying position, engages with corresponding grooves 40 in the reservoir housing 4. The other tooth 39 engages with the groove in a middle position which provides a resistive force to deter the slider from being pushed straight to the actuation position. As best shown in FIG. 9, the teeth 39 are mounted on a resiliently deformable arm which is pivotable about a resilient hinge 41. To release the latch 6 from the locking position, the user pushes downwardly and inwardly on an outwardly facing latch release surface 42. This pushes the toothes 39 out of the grooves 40. The user then pushes the latch 6 to the right to return the latch 6 to its starting position as shown in FIG. 1. In the process, this compresses the spring 30 and resets the catch 21. The device can now be used again following the process set out above.

This mechanism provides a failsafe system to prevent the user activating the device for a second time before it is emptied. Also, the device is positively held in the emptying position and requires the second action on behalf of the consumer to restore the device to a usable state. This allows the user as much time as they need to empty the device and ensures that they must take positive action before the device is ready for use again.

The invention claimed is:

1. A device for cleaning a surface comprising:

a pressurised container containing a cleaning composition;

a nozzle through which the composition is arranged to be dispensed, in use, upon an actuation of a valve; and a shroud attached to the container and surrounding the nozzle;

the shroud having a hollow generally cylindrical portion adjacent to the nozzle for guiding the dispensed product in the direction in which it leaves the nozzle, and a flared portion at the end of the cylindrical portion furthest from the nozzle forming a spreading plate for guiding the dispensed product laterally when in contact, in use, with a surface to be cleaned;

wherein the nozzle is arranged to be actuated by movement of the container towards the shroud;

a reservoir, wherein the nozzle and shroud are configured so that, in use, the cleaning composition is directed across the surface to be cleaned and into the reservoir; and a latch movable into a blocking position upon actuation of the device in which position it blocks a further actuation of the device, the latch being releasable to a position in which the device can be further actuated, the latch being arranged to be moved to an emptying position in which the reservoir can be emptied before it can be moved to the actuating position.

2. A device according to claim 1, wherein the shroud is relatively movable with respect to the reservoir and is biased to a closed position in which it closes the reservoir.

3. A device according to claim 1, wherein the latch is provided with at least one tooth or groove which engages with a respect groove or tooth in the surrounding housing to lock the latch in position with the reservoir open.

4. A device according to claim 1, wherein the spreading plate is annular and centered on the cylindrical portion.

5. A device according to claim 1, further comprising a spacer to maintain a predetermined distance between the spreading plate and the surface to be cleaned.

6. A device according to claim 1, wherein a containment ring surrounds the spreading plate to confine the cleaning composition.

7. A device according to claim 5, wherein the containment ring is the same component as the spacer.

8. A device according to claim 1, wherein the reservoir is an annular chamber which is positioned above the spreading plate and around the hollow cylindrical portion.

* * * * *